US006564776B1

(12) United States Patent
Haeberer et al.

(10) Patent No.: US 6,564,776 B1
(45) Date of Patent: May 20, 2003

(54) FUEL INJECTION SYSTEM

(75) Inventors: Rainer Haeberer, Bretten (DE); Wolfgang Fleiner, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/889,172

(22) PCT Filed: Oct. 27, 2000

(86) PCT No.: PCT/DE00/03797

§ 371 (c)(1),
(2), (4) Date: Sep. 25, 2001

(87) PCT Pub. No.: WO01/36809

PCT Pub. Date: May 25, 2001

(30) Foreign Application Priority Data

Nov. 13, 1999 (DE) ..... 199 54 695

(51) Int. Cl.[7] ..... F02M 37/04

(52) U.S. Cl. ..... 123/456; 123/459; 123/506; 123/514

(58) Field of Search ..... 123/514, 511, 123/506, 456, 457, 459, 446, 462

(56) References Cited

U.S. PATENT DOCUMENTS 6,058,912 A * 5/2000 Rembold et al. ..... 123/179.17
6,079,450 A * 6/2000 Onishi et al. ..... 138/26
6,135,090 A * 10/2000 Kawachi et al. ..... 123/446
6,142,747 A * 11/2000 Rosenau et al. ..... 123/446
6,152,110 A * 11/2000 Miyajima et al. ..... 123/457
6,170,466 B1 * 1/2001 Klinger et al. ..... 123/458
6,234,151 B1 * 5/2001 Eck ..... 123/514
6,293,253 B1 * 9/2001 Arnold et al. ..... 123/446
6,293,296 B1 * 9/2001 Konishi et al. ..... 123/514
6,345,605 B1 * 2/2002 Augustin et al. ..... 123/446
6,345,608 B1 * 2/2002 Rembold et al. ..... 123/456
2002/0092505 A1 * 7/2002 Rembold et al. ..... 123/464

FOREIGN PATENT DOCUMENTS

WO WO 00/20753 * 4/2000 ..... F02M/63/02

* cited by examiner

*Primary Examiner*—Henry C. Yuen
*Assistant Examiner*—Hai Huynh
(74) *Attorney, Agent, or Firm*—Ronald E. Greigg

(57) ABSTRACT

Disclosed is a fuel injection system, in particular a common rail system, for fuel delivery in internal combustion engines, in particular diesel engines of commercial vehicles, with a low pressure circuit in which at least one low-pressure feed pump supplies fuel from a fuel tank to a high-pressure pump which supplies the highly pressurized fuel to a central high-pressure fuel reservoir. In order to simplify the ventilation of the low-pressure circuit, a device is provided for intentionally decreasing the pressure in the low-pressure circuit.

4 Claims, No Drawings

FUEL INJECTION SYSTEM

CROSS-REFERENCE TO RELATED APPLICATIONS

This application is a 35 USC 371 application of PCT/DE 00/03797 filed on Oct. 27, 2000.

BACKGROUND OF THE INVENTION

1. Field of the Invention

The invention relates to a fuel injection system, in particular a common rail system, for fuel delivery in internal combustion engines, in particular diesel engines of commercial vehicles, with a low pressure circuit in which at least one low-pressure feed pump supplies fuel from a fuel tank to a high-pressure pump which supplies the highly pressurized fuel to a central high-pressure fuel reservoir.

2. Description of the Prior Art

In diesel engines, air is taken in and compressed. At the end of the compression stroke, highly pressurized fuel is injected into the combustion chamber, where the mixture of fuel and air self-ignites.

In common rail fuel injection systems, the high-pressure pump, with the aid of the presupply pump, supplies the fuel to be injected from a tank to the central high-pressure fuel reservoir, which is referred to as the common rail. Fuel lines lead from the rail to the individual injectors, which are associated with the cylinders of the internal combustion engine. The motor electronics trigger the injectors individually as a function of the operating parameters of the internal combustion engine in order to inject fuel into the combustion chamber of the engine.

When the fuel tank is emptied or after maintenance work, the low-pressure circuit is filled with air. In conventional fuel injection systems, the air in the low-pressure circuit must be fed through the high-pressure pump into the high-pressure fuel reservoir, counter to the opening pressure (approx. 1.5 bar) of the intake valve of the high-pressure pump. From there, the air can escape via a return line. This venting counter to the opening pressure of the intake valve takes a very long time with conventional low-pressure feed pumps.

In order to accelerate the venting process, low-pressure feed pumps with a larger feed volume could be used. However, low-pressure feed pumps of this kind would be grossly oversized for normal operation. As a result, the fuel flow supplied by a low-pressure feed pump of this kind would have to be throttled during normal operation.

SUMMARY OF THE INVENTION

The object of the invention is to simplify the venting of the low-pressure circuit of a conventional fuel injection system. The fuel injection system according to the invention should also be simply designed and inexpensive to produce.

In a fuel injection system, in particular a common rail system, for supplying fuel to internal combustion engines, in particular diesel engines of commercial vehicles, with a low pressure circuit in which at least one low-pressure feed pump supplies fuel from a fuel tank to a high-pressure pump which supplies the highly pressurized fuel to a central high-pressure fuel reservoir, the object is attained by virtue of the fact that a device is provided for intentionally reducing the pressure in the low-pressure circuit.

ADVANTAGES OF THE INVENTION

As a result, the pressure in the low-pressure circuit can be reduced during venting. This offers the advantage that the air disposed in the low-pressure circuit can be displaced in a justifiable amount of time using a conventional low-pressure feed pump that is not oversized.

A particular embodiment of the invention is characterized in that the low-pressure circuit is connected to the tank by means of a return line in which a throttle is provided. The venting of air from the low-pressure circuit into the tank takes place by means of the throttle. This has the advantage that no large counterpressure has to be overcome during the venting.

Another particular embodiment of the invention is characterized in that the throttle is integrated into an overflow valve which is provided in the return line. The throttle can, for example, be embodied in the form of an intentionally leaky valve seat or as an additional throttle bore. Integrating the throttle into the overflow valve decreases costs.

Another particular embodiment of the invention is characterized in that a venting bore with a vent screw is disposed at the highest point of the low-pressure circuit after assembly, particularly in a metering unit for the high-pressure pump. The air in the low-pressure circuit can escape into the atmosphere via the manually operable vent screw. This embodiment type has the advantage that it is particularly inexpensive to produce because of its simplicity. The venting bore must be situated so that possibly escaping fuel can be collected in a container.

Another particular embodiment of the invention is characterized in that the venting screw has a flattening in the thread region, which permits fuel to pass through the venting bore when the venting screw is turned slightly. This prevents the fuel from spurting out in an uncontrolled manner at the beginning of the venting procedure.

Another particular embodiment of the invention is characterized in that the high-pressure pump is equipped with a metering device that has a solenoid valve which, when supplied with current, opens a connection between the low-pressure circuit and a return into the tank. Normally, the solenoid valve is closed while the internal combustion engine is being started. When the solenoid valve is supplied with current for a short time during venting, the air in the low-pressure circuit can escape into the tank.

Other advantages, characteristics, and details of the invention ensue from the following description in which three exemplary embodiments of the invention are described in detail in conjunction with the single drawing figure which shows a hydraulic connection diagram of a fuel injection system according to the invention.

DESCRIPTION OF THE PREFERRED EMBODIMENTS

For the sake of simplicity, three different embodiments of the current invention are shown by way of example in the accompanying figure. The hydraulic connection diagram will be discussed first below. Subsequent to that, the three embodiments of the invention will be discussed in detail.

Fuel travels from a fuel tank 1, through a line 2, into a cooling body 3. The fuel travels from the cooling body 3, via a line 4, to a hand pump 5. A check valve 6 is connected in parallel with the hand pump 5. The check valve 6 constitutes a bypass which is opened, for example, when the hand pump 5 is damaged or clogged.

After the hand pump 5, a mechanically driven presupply pump 7 is disposed in the line 4. Parallel to the mechanically driven presupply pump 7, there are two check valves 38 and 39 disposed in opposition to each other. The check valves 38 and 39 assure that the presupply pump 7 is bypassed in the event of a particular pressure difference.

After the presupply pump 7, a fuel filter 8 with a water separator is disposed in the line 4. A bypass line (not shown) with a check valve can be connected in parallel with the fuel filter 8.

The fuel supplied by the hand pump 5 or by the mechanically or electrically driven presupply pump 7 travels through the line 4 and a line 9 to a high-pressure pump 10. The high-pressure pump 10 includes two high-pressure pump elements 11 and 12, in which high pressure is exerted on the fuel supplied by the presupply pump 7 or the hand pump 5.

High-pressure lines 13 and 14 which contain check valves 15 and 16 lead from the high-pressure pump elements 11 and 12. The high-pressure lines 13 and 14 connect the high-pressure pump elements 11 and 12 to a central high-pressure fuel reservoir 17. Arrows 18, which lead from the high-pressure fuel reservoir 17, indicate a connection to the individual injectors (not shown) of the internal combustion engine to be fed.

The line 9 contains a quantity regulating valve 19, e.g. of the kind described in DE 197 25 472, on which U.S. Pat. No. 5,996,556 relies for foreign priority, the disclosure of which is hereby incorporated by reference. The quantity regulating valve 19 can connect the line 9 to a return line 24 which feeds into the fuel tank.

The line 4 is also connected to a line 20 which contains a throttle 21. The line 20 can be connected to the return line 24 by means of a 2/2-way solenoid valve 22. When a control unit (not shown) temporarily opens the solenoid valve 22, air possibly contained in the low-pressure circuit can escape into the fuel tank 1 via the line 20 and the return line 24.

Furthermore, the line 4 is connected to the return line 24 by means of a line 25 which contains a check valve 26. According to a second embodiment of the invention, a throttle 27 is connected in parallel with the check valve 26 and permits air possibly contained in the low-pressure circuit to escape into the fuel tank 1.

Finally, according to a third embodiment of the invention, the line 4 is connected to a line 34 which feeds into a container 35. The line 34 suggests a venting bore, which can be closed by means of a vent screw 36.

Finally, it should be noted that the high-pressure fuel reservoir 17 is connected to the cooling body 3 by means of a return line 30 that contains a check valve 31.

The quantity regulating valve 19 and the 2/2-way solenoid valve 22 constitute a metering unit for the high-pressure element 12. The high-pressure element 11 also requires a metering unit of this kind, but this unit is not depicted for the sake of clarity.

The foregoing relates to preferred exemplary embodiments of the invention, it being understood that other variants and embodiments thereof are possible within the spirit and scope of the invention, the latter being defined by the appended claims.

We claim:

1. In a fuel injection system, in particular a common rail system, for fuel delivery in internal combustion engines, with a low pressure circuit (1–9) in which at least one low-pressure feed pump (5, 7) supplies fuel from a fuel tank (1) to a high-pressure pump (10) which supplies the highly pressurized fuel to a central high-pressure fuel reservoir (17), the improvement comprising pressure reducing means for intentionally decreasing the pressure in the low-pressure circuit (1–9), wherein the low-pressure circuit (1–9) is connected to the tank (1) by means of a return line (24, 25) which contains a throttle (27), and the throttle (27) is integrated into a check valve (26) which is provided in the return line (25).

2. In a fuel injection system, in particular a common rail system, for fuel delivery in internal combustion engines, with a low pressure circuit (1–9) in which at least one low-pressure feed pump (5, 7) supplies fuel from a fuel tank (1) to a high-pressure pump (10) which supplies the highly pressurized fuel to a central high-pressure fuel reservoir (17), the improvement comprising pressure reducing means for intentionally decreasing the pressure in the low-pressure circuit (1–9), wherein said pressure reducing means include a venting bore (34) with a vent screw which is disposed at the highest point of the low-pressure circuit (1–9) after assembly of the system.

3. The fuel injection system according to claim 2, wherein the venting screw has a flattening in the thread region, which permits fuel to pass through the venting bore (34) when the venting screw is turned slightly.

4. In a fuel injection system, in particular a common rail system, for fuel delivery in internal combustion engines, with a low pressure circuit (1–9) in which at least one low-pressure feed pump (5, 7) supplies fuel from a fuel tank (1) to a high-pressure pump (10) which supplies the highly pressurized fuel to a central high-pressure fuel reservoir (17), the improvement comprising pressure reducing means for intentionally decreasing the pressure in the low-pressure circuit (1–9), wherein the high-pressure pump (10) is equipped with a quantity regulating valve (19) that has a solenoid valve (22) which, when supplied with current, opens a connection between the low-pressure circuit (1–9) and a return (24) into the tank (1).

* * * * *